US005258052A

United States Patent [19]

Bevington

[11] Patent Number: 5,258,052

[45] Date of Patent: Nov. 2, 1993

[54] POWDER METALLURGY SILVER-TIN OXIDE ELECTRICAL CONTACT MATERIAL

[75] Inventor: Richard C. Bevington, Delmont, Pa.

[73] Assignee: Advanced Metallurgy Incorporated, Export, Pa.

[21] Appl. No.: 900,473

[22] Filed: Jun. 18, 1992

[51] Int. Cl.[5] ..... C22C 29/12

[52] U.S. Cl. ..... 75/234; 75/247; 419/21; 419/22; 419/38; 252/514

[58] Field of Search ..... 75/247, 232, 234; 419/19, 21, 38, 22; 252/514

[56] References Cited

U.S. PATENT DOCUMENTS

| | | | |
|---|---|---|---|
| Re. 29,986 | 5/1979 | Davies et al. | 75/234 |
| 3,969,112 | 7/1976 | Kim et al. | 75/206 |
| 4,095,977 | 6/1978 | Brugner | 75/234 |
| 4,141,727 | 2/1979 | Shida et al. | 75/232 |
| 4,204,863 | 5/1980 | Schreiner | 75/234 |
| 4,330,330 | 5/1982 | Bohm | 148/430 |
| 4,410,491 | 10/1983 | Wolfgang et al. | 420/501 |
| 4,462,841 | 7/1984 | Miyakawa | 148/431 |
| 4,551,301 | 11/1985 | Schreiner | 419/21 |
| 4,565,590 | 1/1986 | Grosse et al. | 148/431 |

*Primary Examiner*—Donald P. Walsh
*Assistant Examiner*—Ngoclan T. Mai
*Attorney, Agent, or Firm*—Armstrong, Westerman, Hattori, McLeland & Naughton

[57] ABSTRACT

A powder metallurgy material for use in the manufacture of electrical contacts and having enhanced cold workability consists essentially, by weight percent, of 5 to 20% tin oxide, 2000 to 5000 ppm, preferably 2000 to less than 4000 ppm copper, 20 to 200 ppm, preferably 20 to 100 ppm, lithium, balance silver. Such materials are produced by compacting the powdered components and heating to sinter the material to at least 93% of theoretical density. Such materials subsequently can be hot or cold worked to a form useful for the manufacture of electrical contacts.

16 Claims, 3 Drawing Sheets

POWDER METALLURGY SILVER-TIN OXIDE ELECTRICAL CONTACT MATERIAL

BACKGROUND OF THE INVENTION

Field of the Invention

This invention relates to an improved powder metallurgy (PM) material useful for the manufacture of electrical contacts. More particularly, the invention relates to an improved powder metallurgy material composed of silver and tin oxide ($SnO_2$) with minor amounts of oxides of copper ($Cu_2O$) and lithium ($Li_2O$) as sintering aids.

Description of Related Art

Silver-tin oxide is of interest as a contact material in the electrical industry primarily as an alternative to the possibly toxic silver-cadmium oxide materials prevalently being used for such applications. One of the principle impediments to acceptance of the silver-tin oxide material has been its higher unit cost as a result of increased manufacturing difficulties and poorer yield as compared to silver-cadmuim oxide. Apparently, the harder, less ductile, more thermodynamically stable tin oxide grains inhibit sinterability of compacted PM compounds to an extent that the resultant sintered compact is brittle, structurally weak and difficult to cold work.

It is known that minor additions of additive metals and/or metal salts can be added to basic PM compositions to enhance sinterability or to impart some desired characteristic to the final product. For example, in U.S. Pat. No. 4,330,330, Bohm teaches that the operating temperature of an electrical switch is lowered if up to five percent (5%) by weight of tungsten oxide ($WO_3$) is added to a basic silver-tin oxide composition. However, such addition has no beneficial effect on sinterability.

It also is known that additions of up to about one-half percent (0.5%) by weight of copper as the oxide ($Cu_2O$) does enhance sinterability. However, even with optimized process conditions, it appears that sintered densities of about ninety percent (90%) of theoretical are the maximum attainable. Although such material is more suitable for subsequent cold working than that without the copper oxide addition, such maximum density still is significantly less than desired for good cold workability.

It is known, too, that lithium oxide is a sintering aid for silver-cadmium oxide PM materials as taught by Kim et al. in U.S. Pat. No. 3,969,112. However, only marginally enhanced interability is achieved with use of lithium oxide.

SUMMARY OF THE INVENTION

In accordance with the present invention, I have found that, even though neither lithium oxide nor copper oxide alone is sufficient to produce high sintered density in silver-tin oxide materials, the combination of lithium and copper oxides together surprisingly produce sintered densities as high as ninety three per cent (93%) of theoretical density. This material is sufficiently strong and ductile that it can be further processed by hot or cold working to a form useful for the manufacture of electrical contacts. An additional advantage of this material is that the compacted density has no effect on the ability of the material to sinter to high density. For example, powder compacted to about seventy five percent (75%) density still will sinter to at least ninety three percent (93%) of theoretical density.

DESCRIPTION OF THE PREFERRED EMBODIMENT

According to the present invention, sintered density of silver-tin oxide materials containing from about 5 to about 20 weight percent $SnO_2$ is enhanced by the addition thereto of from about 2000 to about 5000 parts per million (ppm) copper, more particularly from about 2000 to under 4000 ppm copper, and especially from about 2000 to about 3000 ppm copper, as oxide, and from about 20 to about 200 ppm lithium, preferably from about 20 to about 100 ppm lithium, as oxide, and where the balance of the composition is essentially silver. Enhanced density upwards of 93% is achievable with such compositions.

In contrast, additions of lithium alone (as oxide) from about 20 ppm to about 200 ppm results in a maximum sintered density of about 75%, which is lower than necessary for cold working.

Similarly, additions of copper alone (as oxide) from about 1500 to about 5000 ppm result in a maximum sintered density of about 90% of theoretical, which still is less than desirable for best cold working characteristics.

Figure 1:
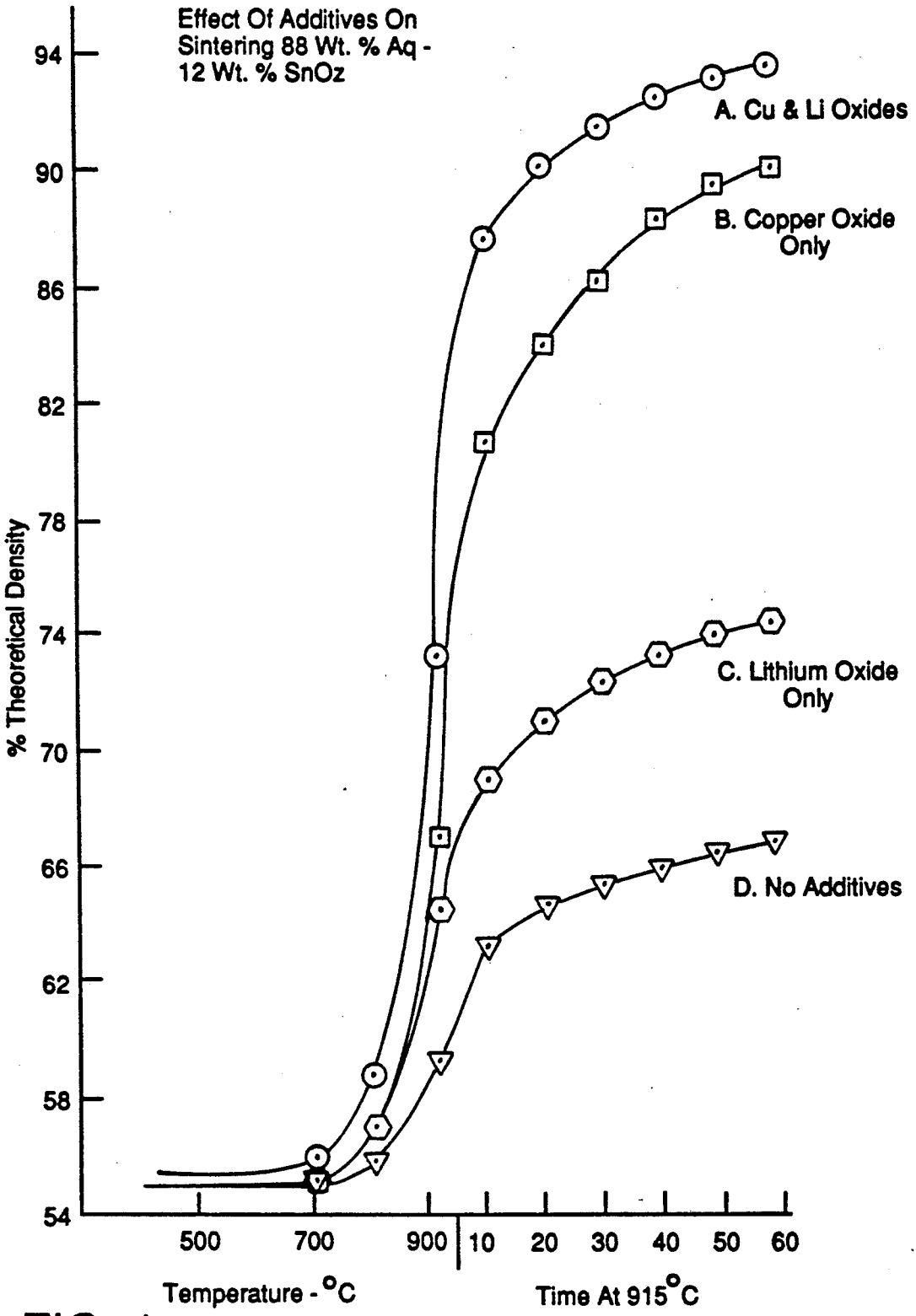
FIG. 1 comprises a plurality of graphs relating (a) per cent theoretical density of silver-tin oxide materials with and without additives and (b) temperature and time to which such materials are heated for sintering.

The significance of the invention is readily apparent from an inspection of the graphs of FIG. 1, wherein curve A represents the density of an 88% Ag, 12% $SnO_2$ (percentages by weight) material which contains 25 ppm lithium and 2500 ppm copper (as oxides) and the material is heated in ambient air to 915° C. and held at that temperature for one hour. From that curve, it is seen that the sintered density after such treatment is over 93% of the theoretical density.

In contrast, curve B represents the same silver-tin oxide material which contains 2500 ppm copper (as oxide) only. In that case, the percent of theoretical density, after the same treatment, was only 90%.

Similarly, curve C represents the same silver-tin oxide material which contains 25 ppm lithium (as oxide) only. In that case, the percent of theoretical density, after the same treatment, was only just over 74%.

Finally, curve D represents the same silver-tin oxide material which contains no additives. In that case, the percent of theoretical density, after the same treatment, was only about 67%.

Figure 2:
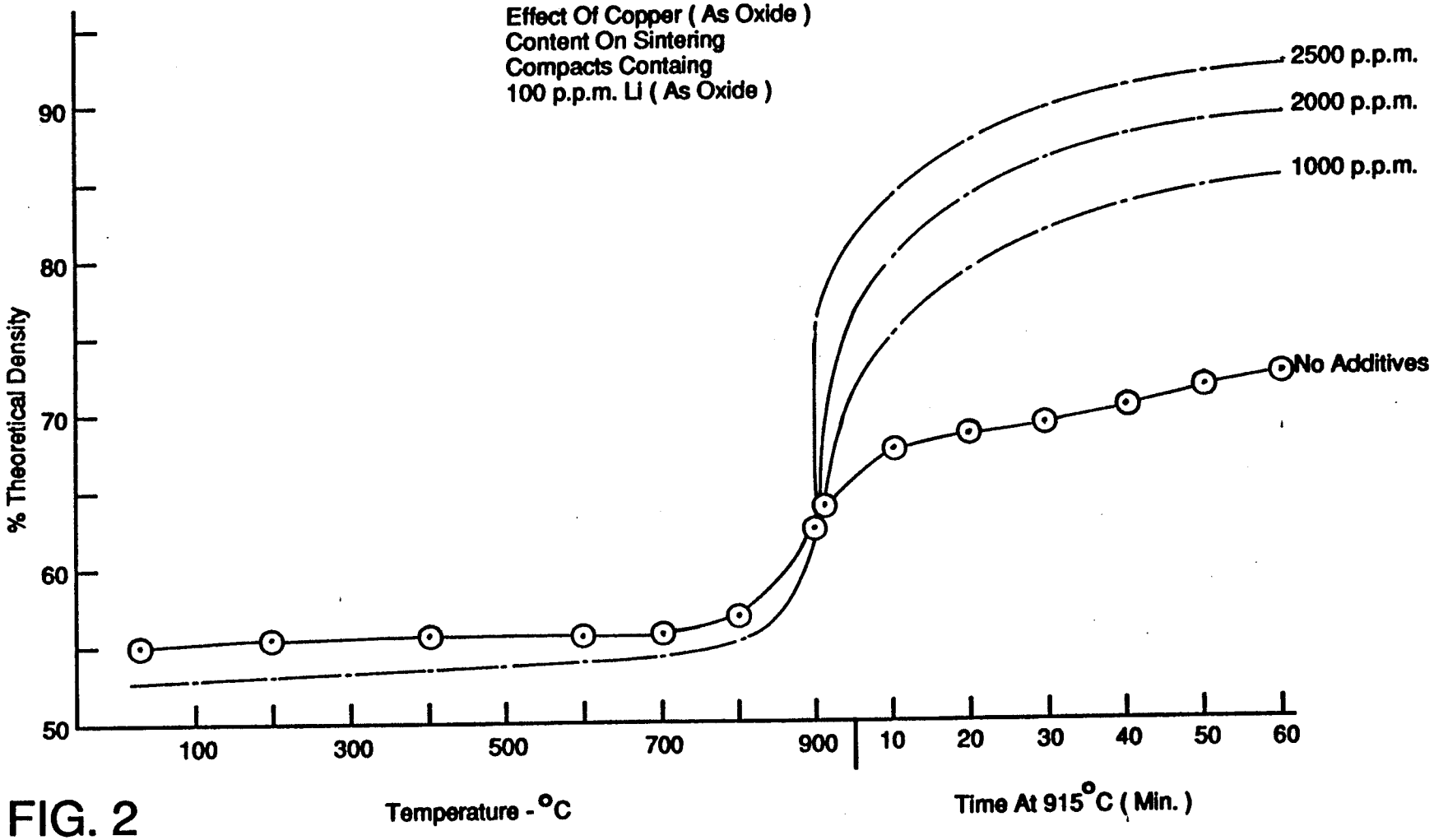
FIG. 2 comprises a number of graphs relating percent theoretical density and temperature and time of sintering for silver-tin oxide materials containing various amounts of copper, as oxide.

Tests were conducted with specimens containing various amounts of copper together with 100 ppm lithium (as oxides), as shown in FIG. 2. From that Figure, it is seen that there is an optimum copper content at about 2500 ppm. Adding 1000 ppm copper increases the sintered density from the base composition (silver-tin oxide) density of about 72% of theoretical density to about 85%. Increase of copper content to 2500 ppm results in a density of about 92% of theoretical, but when further copper addition is made in amount of 4000 ppm, the sintered density falls to about 89%. Further, similar tests with copper at about 3000 ppm gave essentially the same results as with 2500 ppm.

Figure 3:
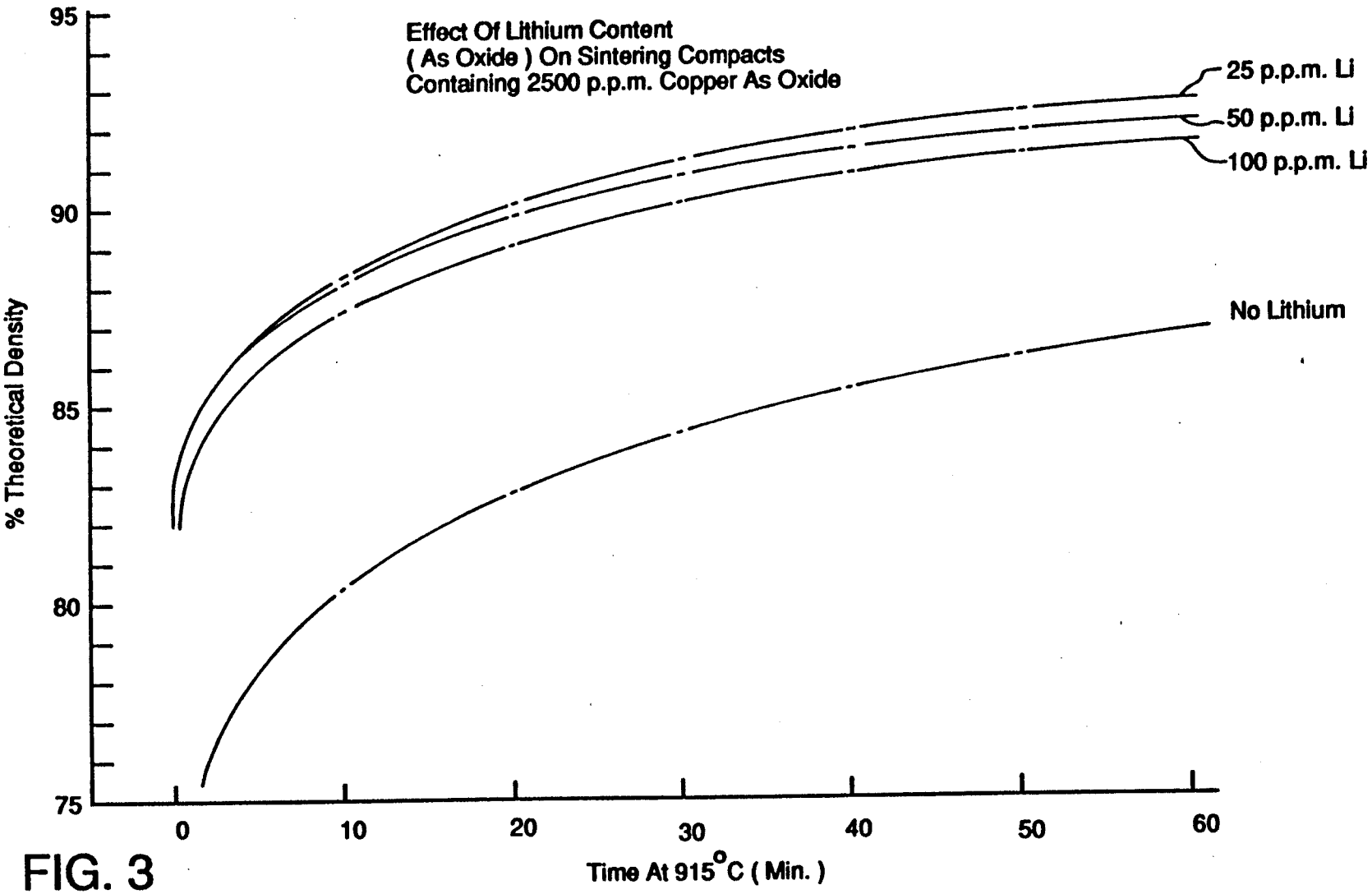
FIG. 3 comprises a number of graphs relating percent theoretical density and time of heating at 915° C. silver-tin oxide compositions containing various amounts of lithium, as oxide.

FIG. 3 shows the effect of different amounts of lithium to sintering compact compositions containing 2500 ppm copper. As seen in that Figure, best results are obtained with use of about 25 ppm lithium, although great improvements also are provided with lithium additions up to 100 ppm, as compared to no lithium addition.

What is claimed is:

1. A sinterable powder metallurgy material useful for the manufacture of electrical contacts and having enhanced cold workability, consisting essentially, by weight percent, of:

| | |
|---|---|
| tin oxide | from about 5 to about 20%; |
| copper | from about 2000 to about 5000 ppm; |
| lithium | from about 20 to about 200 ppm, and |
| silver | balance, except for incidental impurities, |

and wherein, after sintering in air, the copper and lithium components are present in the form of their respective oxides.

2. A material according to claim 1, wherein the copper content is from about 2000 ppm to less than about 4000 and the lithium content is from about 20 to about 100 ppm.

3. A material according to claim 1, wherein the copper content is from about 2000 ppm to about 3000 ppm and the lithium content is from about 20 to about 100 ppm.

4. A material according to claim 1, wherein the tin oxide content is about 12, the copper content is about 2500 ppm and the lithium content is about 25 ppm.

5. An electrical contact made of the material of claim 1.

6. An electrical contact made of the material of claim 2.

7. An electrical contact made of the material claim 3.

8. An electrical contact made of the material of claim 4.

9. A method of enhancing the cold workability of a silver-tin oxide power metallurgy base material, comprising adding to a mixture of silver and tin oxide powders from about 2000 to about 5000 ppm copper, and from about 20 to about 200 ppm of lithium.

10. A method according to claim 9, wherein the base material consists essentially, by weight percent, of from about 5 to about 20%tin oxide and balance silver except for incidental impurities.

11. A method according to claim 10, wherein the copper content is from about 2000 ppm to less than 4000 ppm, and the lithium content is from about 20 to about 100 ppm.

12. A method according to claim 11, further comprising mixing powders of silver and tin oxide with copper- and lithium- containing materials , compacting the resulting mixture, and sintering the compacted mixture to provide a material having a density of at least about 95% of the theoretical density.

13. An electrical contact material made by the method of claim 9.

14. An electrical contact material made by the method of claim 10.

15. An electrical contact material made by the method of claim 11.

16. An electrical contact material made by the method of claim 12.

* * * * *

UNITED STATES PATENT OFFICE

CERTIFICATE OF CORRECTION

PATENT NO. : 5,258,052

DATED : Nov. 2, 1993

INVENTOR(S) : Richard C. Bevington

It is certified that error appears in the above-identified patent and that said Letters Patent is hereby corrected as shown below:

In the Drawings

Fig. 1, in the legend, "SnOz" should read ---$SnO_2$"---.

Fig. 2, the graph marked "2000 ppm", lying above the graph marked "1000 ppm" and below the graph marked "2500 ppm", should bear the legend ---4000 ppm--- instead of "2000 ppm".

Col. 1, line 24, "cadmuim" should read ---cadmium---.

Col. 1, line 52, "interability" should read ---sinterability---.

UNITED STATES PATENT AND TRADEMARK OFFICE

CERTIFICATE OF CORRECTION

PATENT NO. : 5,258,052

DATED : Nov. 2, 1993

INVENTOR(S) : Richard C. Bevington

It is certified that error appears in the above-indentified patent and that said Letters Patent is hereby corrected as shown below:

Col. 4, line 2, after "12" insert ---%---.

Col. 4, line 29, "95%" should read ---93%---.

Signed and Sealed this

Tenth Day of May, 1994

Bruce Lehman

*Attest:*

BRUCE LEHMAN

*Attesting Officer*

*Commissioner of Patents and Trademarks*